US008567387B2

(12) United States Patent
Binzer

(10) Patent No.: US 8,567,387 B2
(45) Date of Patent: Oct. 29, 2013

(54) UNVENTED GAS FIREPLACE

(75) Inventor: Dan Binzer, Langley (CA)

(73) Assignee: Canadian Heating Products Inc., Langley (CA)

( * ) Notice: Subject to any disclaimer, the term of this patent is extended or adjusted under 35 U.S.C. 154(b) by 269 days.

(21) Appl. No.: 13/018,720

(22) Filed: Feb. 1, 2011

(65) Prior Publication Data

US 2012/0192854 A1 Aug. 2, 2012

(51) Int. Cl.
*F24B 1/18* (2006.01)

(52) U.S. Cl.
USPC ..... 126/523; 126/521; 126/512; 126/527; 126/529

(58) Field of Classification Search
USPC ..... 126/521, 523, 525, 527, 528, 529, 512
See application file for complete search history.

(56) References Cited

U.S. PATENT DOCUMENTS

| | | | |
|---|---|---|---|
| 2,696,205 | A | 12/1954 | Ruhl |
| 5,054,468 | A | 10/1991 | Moon et al. |
| 5,139,011 | A | 8/1992 | Moon |
| 5,678,534 | A | 10/1997 | Fleming |
| 5,701,882 | A | 12/1997 | Champion |
| 5,906,197 | A | 5/1999 | French et al. |
| 6,145,502 | A | 11/2000 | Lyons et al. |
| 6,425,390 | B2 | 7/2002 | Campbell et al. |

*Primary Examiner* — Alfred Basichas
(74) *Attorney, Agent, or Firm* — Smiths IP; Paul R. Smith

(57) ABSTRACT

An unvented gas fireplace in which air flow through a closed combustion chamber is controlled by means of a restriction in the air flow path through an outer plenum chamber surrounding the combustion chamber. The restriction in the air flow path through the plenum causes a pressure differential between the plenum and combustion chamber, forcing air from the plenum into the combustion chamber, where it is combusted and mixed with the cool air that has passed the restriction in the plenum, before the air mixture is exhausted into the surrounding room, thereby heating the room.

6 Claims, 3 Drawing Sheets

UNVENTED GAS FIREPLACE

FIELD OF THE INVENTION

This invention relates to an improved unvented gas fireplace. In particular, the invention relates to an unvented linear gas fireplace in which the air flow into a unvented closed combustion chamber is controlled by a restriction in the path of the air flow through a plenum chamber around the combustion chamber.

BACKGROUND OF THE INVENTION

Gas-fired fireplaces are becoming extremely popular because they are generally cleaner, safer and less expensive to build than wood-fired fireplaces. Unvented gas-fired fireplaces in particular have become increasingly popular, because they allow the consumer to fit or retrofit a fireplace into any pre-existing room having a gas line, without incurring the costs associated with chimney construction or construction of a venting system. Further, because unvented fireplaces do not require chimneys or flues, it is possible to locate the fireplace in practically any location. For example, the fireplace may be located against a wall, or in a corner, or in the middle of a room, where the flame is visible from two or more sides. The fireplace may also be of any shape and size, depending on the location in which it is to be installed.

Such fireplaces are considered to be highly efficient, drawing room air in for combustion and returning the warmed air directly to the room. However, because unvented fireplaces vent most or all of the combustion products to the directly to the room rather than outside, they must meet rigid standards, requiring that the fireplace burn extremely efficiently in order to minimize the buildup of the combustion products.

U.S. Pat. No. 2,696,205 to Ruhl describes a space heater that operates similarly to a typical unvented fireplace. The heater comprises a heater unit surrounded by a series of flues and baffles. Ambient air passes through the heater section, where it is combusted by a flame within a metal radiant element. The flow of the combustion air from the heater to the surrounding room is partially controlled by a deflecting choke surface, which accelerates expulsion of the heated air by increasing the air pressure at the choke. A second stream of air also freely flows behind the heater unit, through the flues and out the baffles. This second stream of air is warmed by thermal contact with the flues and thus also warms the room, but in addition it serves a cooling function, ensuring that the area immediately around the rear of the heater does not get too hot.

U.S. Pat. No. 5,054,468 to Moon et al. describes an unvented fireplace assembly consisting of two chambers, namely a combustion chamber surrounded by a plenum chamber. Ambient air moves through the plenum chamber, warming by contact with the outside of the combustion chamber, before returning to the room in which the fireplace is located. Air is also pulled directly into the combustion chamber by a fan; the heated combustion air is then expelled back into the room. U.S. Pat. No. 5,139,011 to Moon describes a similar unvented fireplace with a pair of airflow paths. Ambient air passes through a duct assembly around the combustion chamber, heating the air before returning it to the room. Combustion air is again pulled directly into the combustion chamber by a fan and heated before being returned to the room.

Each of these patents uses a dual intake system, which makes the system more complex, and makes it difficult to maintain a steady flow of air into both airflow pathways. If air moves relatively quickly into the combustion chamber, for example, there may not be sufficient plenum airflow to cool the area outside the combustion chamber. Further, in each of these cases, the combustion air and the plenum air are expelled into the room at different places and likely at different rates. The combustion air is hotter than the radiantly heated plenum air, which can lead to undesirable localized temperature variations.

U.S. Pat. No. 5,678,534 to Fleming and U.S. Pat. No. 5,906,197 to French each disclose a single-intake fireplace in which the incoming airflow is divided into several pathways, one flowing to the combustion chamber, and the others flowing to various convection pathways or plenum chambers surrounding the combustion chamber. The air from the plenum or convection areas is then mixed with the combustion air before being returned to the room. In order to minimize the combustion products being expelled into the room, the combustion air passes through a catalytic converter to convert any combustion products to carbon dioxide and water before the combustion air mixes with the plenum air and re-enters the room.

U.S. Pat. No. 6,425,390 to Campbell and U.S. Pat. No. 5,701,882 to Champion each disclose a gas fireplace in which combustion air is drawn directly into the combustion chamber while a second pathway for room air is provided in one or more plenum chambers surrounding the combustion chamber. Neither Campbell nor Champion disclose a combustion chamber that is essentially sealed from the surrounding room, meaning that there is little to no control over the amount of air passing into the combustion chamber. This may adversely affect the appearance of the flame and the efficiency of burning within the combustion chamber.

It is therefore an object of this invention to provide an unvented gas fireplace that overcomes one or more of the disadvantages found in the prior art fireplaces referred to above.

SUMMARY OF THE INVENTION

The invention comprises an unvented gas fireplace in which air flow through a closed combustion chamber is controlled by means of a restriction in the air flow path through an outer plenum chamber surrounding the combustion chamber. The restriction in the air flow path through the plenum chamber causes a pressure differential between the plenum and combustion chambers. The relative increase in plenum chamber pressure forces air into the combustion chamber, where it is combusted and mixed with the air in the plenum chamber before the air mixture is exhausted into the surrounding room.

In one aspect, the invention comprises an unvented gas fireplace comprising a closed combustion chamber; a plenum outside of the combustion chamber, the plenum having an ambient air intake to receive air from a room in which the fireplace is located, and an ambient air outlet to exhaust air into the room; the plenum comprising a restriction, the restriction adapted to cause a positive air pressure differential between the plenum and the combustion chamber, upstream of the restriction; wherein the increase in air pressure forces air into the combustion chamber through a combustion air intake between the combustion chamber and the plenum; and wherein heated air is exhausted from the combustion chamber into the plenum through a combustion air outlet between the restriction and the ambient air outlet. The fireplace may further comprise at least one blower to pull air into the ambient inlet, and may comprise ducting between the ambient inlet and the blower.

In a further aspect of the invention, the heated air from the combustion chamber may be mixed with cool air in the plenum before exhausting the mixed air from the fireplace.

In another aspect, the invention comprises a method of heating a room with an unvented gas fireplace having a plenum outside of a closed combustion chamber, comprising the steps of receiving a flow of ambient air from the room into the plenum; restricting the flow of ambient air at a restriction in the plenum to create a positive air pressure differential between the plenum and the combustion chamber upstream of the restriction, and thereby force air from the plenum into the combustion chamber through a combustion air intake; exhausting heated air from the combustion chamber to the plenum downstream of the restriction; mixing the heated air with cool air within the plenum to form warm air; and exhausting the warm air to the room. In a further aspect, the method may comprise the additional step of blowing ambient air from the room into the plenum through an ambient air intake.

In yet another aspect, the invention comprises an unvented gas fireplace comprising a closed combustion chamber; a plenum outside of the combustion chamber for carrying air from an ambient air intake to an ambient air outlet; the plenum comprising a restriction, the restriction adapted to cause a positive air pressure differential between the plenum and the combustion chamber, upstream of the restriction; wherein the increase in air pressure forces air into the combustion chamber through a combustion air intake between the combustion chamber and the plenum; and wherein heated air is exhausted from the combustion chamber into the plenum through a combustion air outlet between the restriction and the ambient air outlet.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

The invention will be described by reference to the detailed description of the preferred embodiment and to the drawings thereof in which.

DETAILED DESCRIPTION OF THE PREFERRED EMBODIMENT

Figure 1:
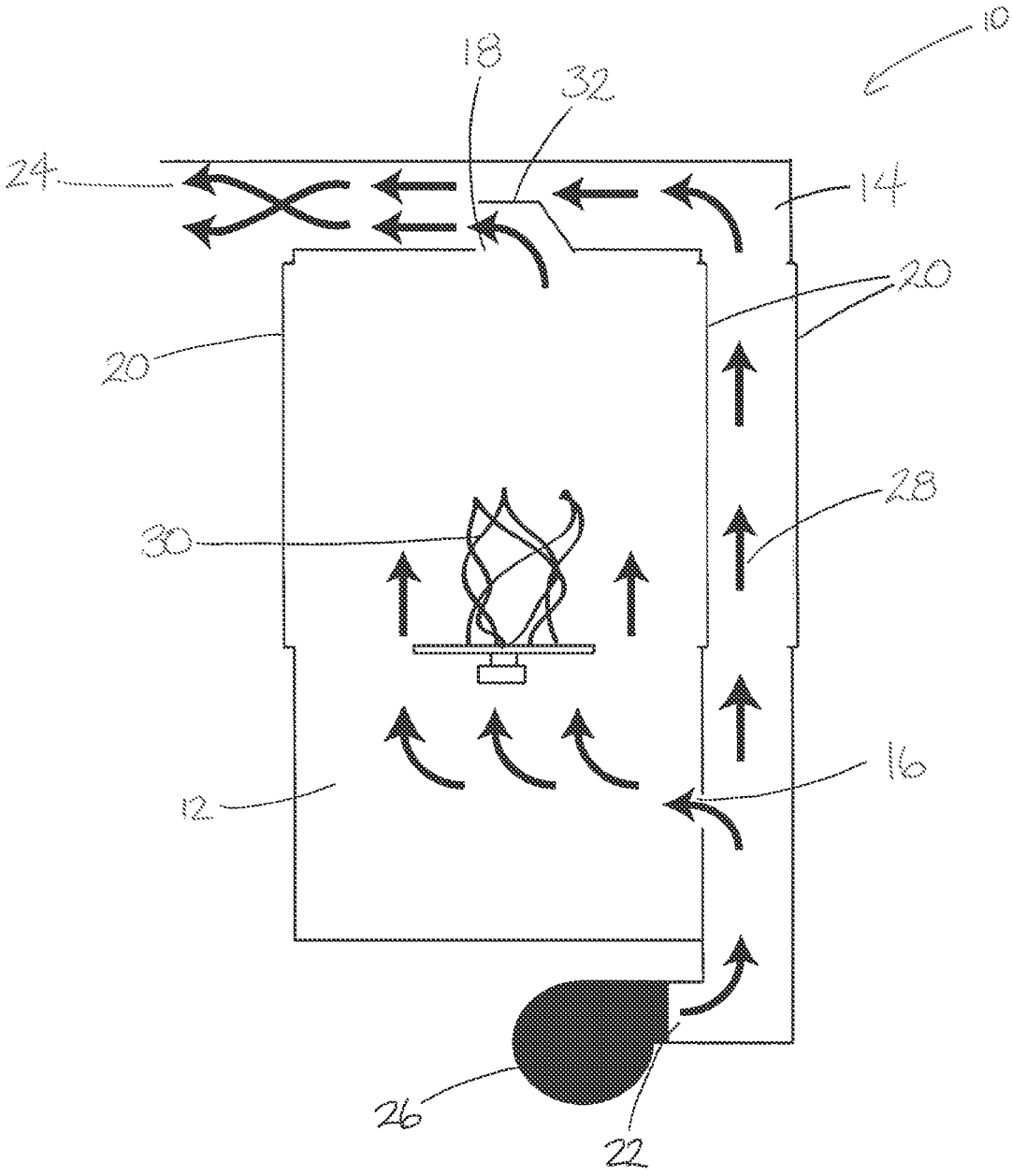
FIG. 1 is a side sectional schematic view of an unvented gas fireplace according to an embodiment of the invention.

A first embodiment of the fireplace of the invention is shown in FIG. 1. Fireplace 10 comprises a combustion chamber 12 at least partially within an outer or plenum chamber 14. Combustion chamber 12 is closed with respect to the room in which the fireplace 10 is located, in that combustion air intake 16 and combustion air outlet 18 of combustion chamber 12 are not in direct communication with the surrounding room. Rather, combustion air intake 16 receives air only from plenum 14 and combustion air outlet 18 exhausts only into plenum 14. Panels 20 are provided on one or more sides of combustion chamber 12; these panels may be glass or any other suitable transparent material to permit viewing of the flame 30 within the combustion chamber 12, or may be metal or any other suitable opaque material if such viewing is not required.

Air from the surrounding room accesses fireplace 10 through ambient air intake 22 in the plenum 14, while air is exhausted from fireplace 10 through ambient air outlet 24 of plenum 14. Blower 26 may be used at or near ambient air intake 22 to draw air into plenum 14.

Under startup conditions, air entering the fireplace 10 through ambient air intake 22 will preferentially remain in plenum 14, flowing along path 28, without a great deal of air entering combustion air intake 16, because the size of path 28 is much greater than that of combustion air intake 16. However, path 28 is provided with restriction 32, a relatively narrow section of path 28, which restricts the air flow through path 28. This backs up the air between restriction 32 and blower 26, causing a positive pressure differential between plenum 14 and combustion chamber 12, upstream of the restriction. The pressure differential forces air in plenum 14 to enter combustion chamber 12 through combustion air intake 16, which is preferably located below the flame 30, and which may take the form of one or more openings arranged in any suitable pattern. The air is heated within combustion chamber 12, and rises above the flame, where it escapes through combustion air outlet 18, which may also take the form of one or more openings arranged in any suitable pattern. The pressure differential between plenum 14 and combustion chamber 12 therefore helps to maintain the pressure and air velocity within combustion chamber 12, by forcing air through the chamber 12 without over-pressurizing it.

Restriction 32 is shown in FIG. 1 as being in an upper part of path 28, but it will be understood that it may be located anywhere within plenum 14 along path 28 between combustion air intake 16 and combustion air outlet 18.

Air entering combustion chamber 12 assists in the combustion reaction to create flame 30 and hot air, which exits the combustion chamber 12 at combustion air outlet 18. When the hot air exits combustion chamber 12 into path 28 in plenum 14, it may exhaust directly into the room or to the outside, or it may mix with relatively cool air that has flowed along path 28 through restriction 32. The combination of hot and cool air flows creates a warm air flow that exhausts to the surrounding room or to the outside at ambient air outlet 24. Combustion air outlet 18 is shown as being at the top of combustion chamber 12, which may be preferred because the heated air will naturally rise towards the combustion air outlet 18. However, it will be understood that combustion air outlet 18 may appear anywhere in path 28 between restriction 32 and ambient air outlet 24. Factors such as the preferred time available for the heated air to mix with the cool air flowing through path 28 may influence the exact location of combustion air outlet 18. It will also be understood that path 28 can be of any preferred shape and length, such that ambient air outlet 24 terminates at any desired point, such as at the top of the fireplace 10 (as shown in FIG. 1) or anywhere along the bottom or side of the fireplace 10, thus providing a stream of warm air to the surrounding room or to the outside at any desired point.

Figure 2:
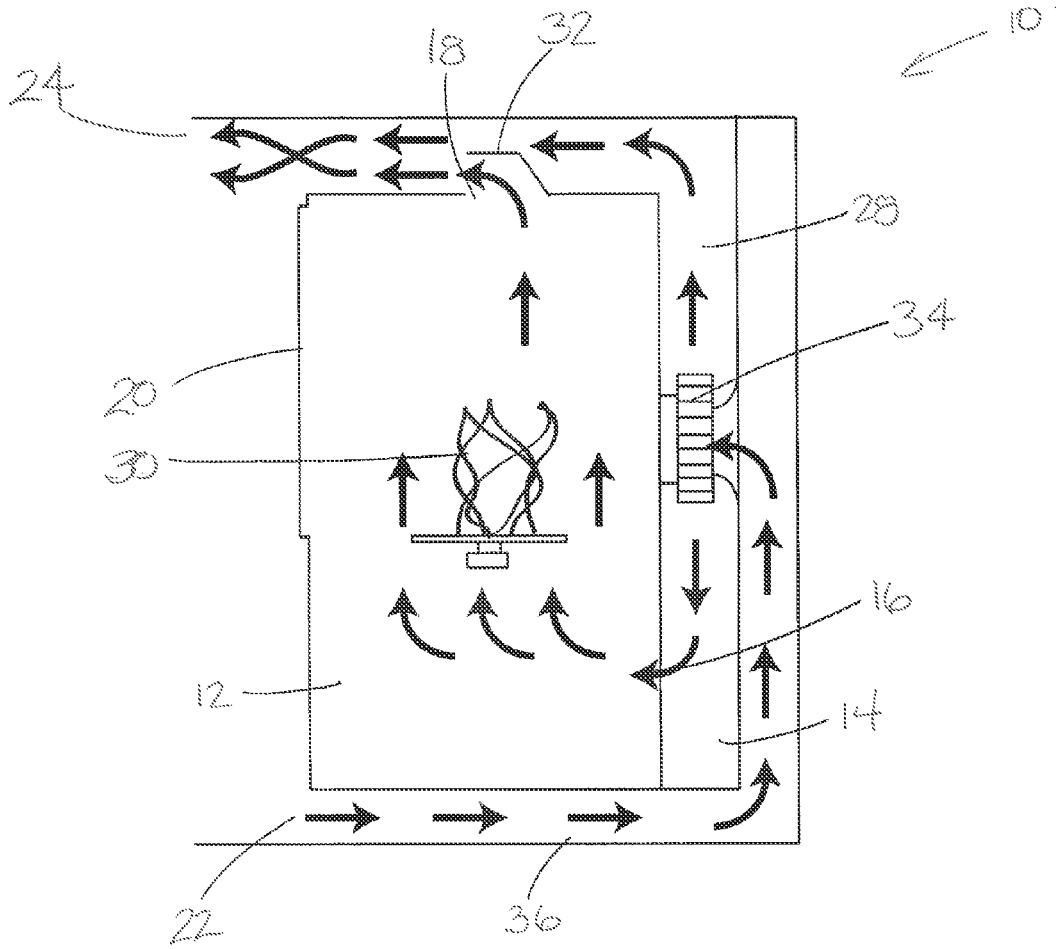
FIG. 2 is a side sectional schematic view of an unvented gas fireplace according to another embodiment of the invention.
Figure 3:
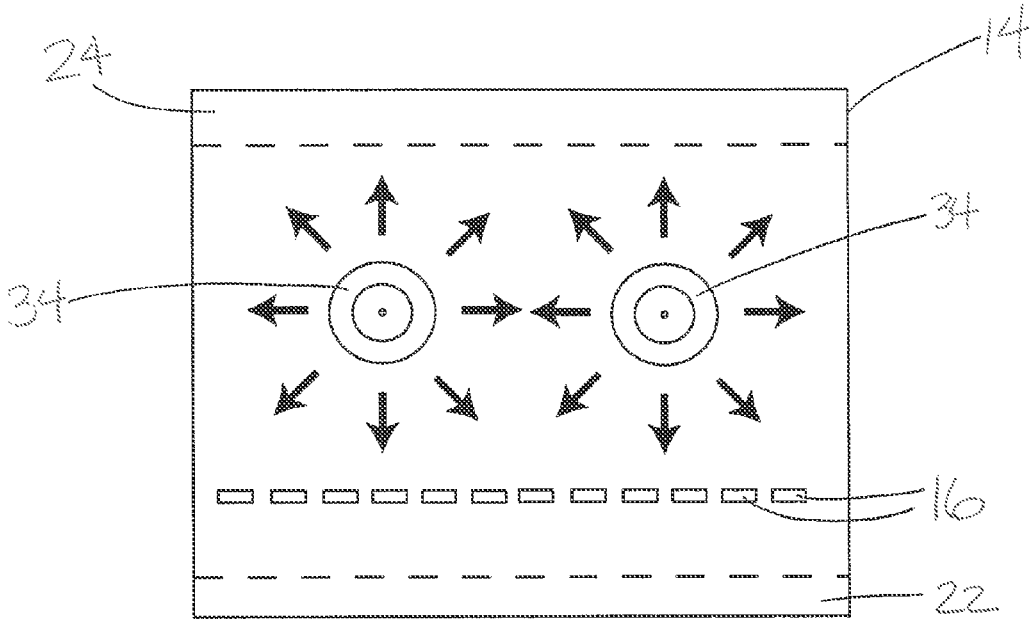
FIG. 3 is a front view of the unvented gas fireplace of FIG. 2 with the combustion chamber removed.

Another embodiment of the unvented fireplace 10 of the invention is shown in FIGS. 2 and 3. This embodiment works essentially in the same manner as the embodiment described above, although in this embodiment, blower 26 of FIG. 1 is replaced by one or more backward inclined blowers 34. Further, blower 34 (or an equivalent fan or blower assembly) may be placed anywhere suitable within path 28, and additional ducting 36 may be used as necessary between ambient air intake 22 and blower 34. Blower 34 draws air into plenum 14 through ducting 36, and distributes it throughout the plenum

14. Restriction 32 causes an increase in air pressure in the plenum 14, forcing air from plenum 14 through combustion air intake 16 (which may take the form of one or more openings arranged in any suitable pattern), and into combustion chamber 12. The combustion air rises towards the top of combustion chamber 12 as it is heated. The air then passes out of combustion chamber 12, where it may be exhausted directly to the ambient room in which the fireplace is located or to the outside, but preferably it is exhausted into path 28 of plenum 14 via combustion air outlet 18. The heated combustion air mixes with cool air that has flowed along path 28 past restriction 32, creating a warm air mixture that may be vented through ambient air outlet 24. Again, it will be understood that path 28 can be of any preferred shape, such that ambient air outlet 24 terminates at any desired point along the top, bottom or side of the fireplace 10, thus providing a stream of warm air to the surrounding room or to the outside wherever it is preferred.

It will be appreciated by those skilled in the art that the preferred embodiment has been described in some detail but that certain modifications may be practiced without departing from the principles of the invention.

The invention claimed is:

1. An unvented gas fireplace comprising:

a substantially closed combustion chamber;

a plenum for circulating air outside of and around said combustion chamber, said plenum having an ambient air intake to receive air from a room in which the fireplace is located and an air outlet to exhaust air into said room;

a fan for drawing air from said room and for pressurizing said plenum;

said combustion chamber comprising an air inlet from said plenum into said combustion chamber, said air inlet downstream from said fan, and an air outlet from said combustion chamber into said plenum;

said plenum comprising a restriction located between said combustion chamber air inlet and said combustion air outlet, said fan and said restriction cooperating to cause a positive air pressure differential between said plenum and said combustion chamber, upstream of said restriction and at said combustion chamber air inlet, whereby to force a portion of the air in said plenum to enter said air inlet from said plenum to said combustion chamber while allowing the balance of the air in said plenum to proceed to said air outlet;

and wherein heated air is exhausted from said combustion chamber into said plenum through said combustion air outlet between said restriction and said air outlet.

2. The gas fireplace of claim 1 further comprising at least one blower to pull air into said ambient inlet.

3. The gas fireplace of claim 2 further comprising ducting between said ambient inlet and said blower.

4. The gas fireplace of claim 1 wherein said heated air is mixed with cool air in said plenum before exhausting the mixed air from said fireplace.

5. A method of heating a room with an unvented gas fireplace having a substantially closed combustion chamber, and a plenum for circulating air outside of and around said combustion chamber, said comprising the steps of:

Receiving from a fan, a flow of ambient air from said room into said plenum and thereby pressurizing said plenum;

restricting said flow of ambient air at a restriction in said plenum between a combustion air intake from said plenum, said combustion air intake being downstream from said fan, and a combustion air outlet into said plenum to create a positive air pressure differential between said plenum and said combustion chamber upstream of said restriction, and thereby force air from said plenum into said combustion chamber through said combustion air intake;

exhausting heated air from said combustion chamber to said plenum through said combustion air outlet downstream of said restriction;

mixing said heated air with cool air within said plenum to form warm air; and exhausting said warm air to said room.

6. The method of claim 5 further comprising the step of blowing ambient air from said room into said plenum through an ambient air intake.

* * * * *